US005659928A

United States Patent [19]

Komaki

[11] Patent Number: 5,659,928

[45] Date of Patent: Aug. 26, 1997

[54] OPENABLE STRUCTURE FOR HOUSING

[75] Inventor: Eisuke Komaki, Tokyo, Japan

[73] Assignee: NEC Corporation, Tokyo, Japan

[21] Appl. No.: 654,879

[22] Filed: May 29, 1996

[30] Foreign Application Priority Data

May 31, 1995 [JP] Japan ..... 7-133261

[51] Int. Cl.[6] ..... E05C 17/64; E05D 7/10

[52] U.S. Cl. ..... 16/338; 16/264; 16/266

[58] Field of Search ..... 16/338, 342, 264, 16/265, 266, 270

[56] References Cited

U.S. PATENT DOCUMENTS

| | | | |
|---|---|---|---|
| 4,584,739 | 4/1986 | Konen | 16/266 |
| 4,979,264 | 12/1990 | Ramsauer | 16/264 |
| 5,481,783 | 1/1996 | Liou | 16/264 |

FOREIGN PATENT DOCUMENTS

| | | | |
|---|---|---|---|
| 8222340 | 11/1982 | Germany | 16/266 |
| 5-3553 | 1/1993 | Japan . | |

*Primary Examiner*—Chuck Y. Mah
*Attorney, Agent, or Firm*—Young & Thompson

[57] ABSTRACT

An opening/closing structure for a housing includes a box-shaped case, a cover, at least a pair of opposing first hinge members, a second hinge member, a support shaft, a groove, and a screw. The housing has an opening portion. The cover closes the opening portion of the case. The first hinge members have through holes and are formed on one of the case and cover. The second hinge member has a through hole and is formed on the other one of the case and cover to correspond to the first hinge members. The second hinge member is brought into contact with an outer side of one of the first hinge members to attach the cover to the case. The support shaft has a screw hole in its outer surface and is inserted in the through holes of the first hinge members and the second hinge member to support the cover to be openable/closeable with respect to the case. The groove is formed in the cover at a position to correspond to a portion between the first hinge members and is open in a direction perpendicular to an axial direction of the support shaft. The screw is threadably engaged in the screw hole of the support shaft through the groove to clamp and fix the first hinge members and the second hinge member.

10 Claims, 3 Drawing Sheets

OPENABLE STRUCTURE FOR HOUSING

BACKGROUND OF THE INVENTION

The present invention relates to an opening/closing structure for a housing consisting of a cover and a case and, more particularly, to an opening/closing structure for the housing of a communications equipment mounted at the elevated spot of, e.g., a pylon or a utility pole.

In general, a housing mounted at an elevated spot requires an opening/closing structure having excellent workability and operating efficiency. FIG. 5 shows a conventional opening/closing structure for a housing. Referring to FIG. 5, reference numeral 20 denotes a box-shaped case having screw holes 20*a* formed at the four corners of its opening portion which is open upward; and 21, a cover for closing the opening portion of the case 20. Screw insertion holes 21*a* corresponding to the screw holes 20*a* are formed in the four corners of the cover 21. In this arrangement, the cover 21 is opened or closed by threadably engaging or disengaging screws 22 inserted in the screw insertion holes 21*a* in or from the screw holes 20*a*.

In this arrangement, however, since the cover 21 is opened and removed from the case 20, if the housing is mounted at an elevated spot where a place to set aside the cover 21 cannot be assured, the opening/closing operation of the cover 21 is hindered.

In order to solve this problem, an opening/closing structure for a housing as shown in FIG. 6 is proposed. This opening/closing structure will be described with reference to FIG. 6. Reference numeral 2 denotes a case having the same shape as that of FIG. 5. A pair of brackets 3 each formed with a screw hole 3*a* are integrally formed on the upper portions of one side surface of the case 2. Two pairs of opposing hinge members 4 and 5 are integrally formed on the upper outer portions of the opposite side surface of the case 2. Through holes 4*a* and 5*a* are formed respectively in each pair of hinge members 4 and 5. Reference numeral 7 denotes a cover formed into a flat plate. A pair of brackets 8 each having a screw insertion hole 8*a* are integrally formed on one end face of the cover 7 to correspond to the brackets 3. Two brackets 30 each having a screw insertion hole 30*a* are integrally formed on the opposite end face of the cover 7 to correspond to the hinge members 4 and 5. Reference numerals 14 denote support shafts each horizontally fitted and inserted in the through holes 4*a* and 5*a* of each of the hinge members 4 and 5. A screw hole 14*a* is formed at the axial center of the outer surface of each support shaft 14.

In this arrangement, when the cover 7 is to be attached to the case 2, the cover 7 is placed on the case 2 such that its brackets 8 overlap the brackets 3 of the case 2 and that its two brackets 30 overlap the hinge members 4 and 5. Subsequently, screws 15 are inserted in the screw insertion holes 8*a* of the brackets 8 and threadably engaged in the screw holes 3*a* of the brackets 3 of the case 2, thereby fixing the brackets 8 of the cover 7 to the brackets 3 of the case 2. Then, screws 16 are inserted in the screw insertion holes 30*a* of the brackets 30 and threadably engaged in the screw holes 14*a* of the support shafts 14 that have been fitted and inserted in the through holes 4*a* and 5*a* of the hinge members 4 and 5 in advance, thereby attaching the cover 7 to the case 2. The cover 7 attached in this manner can be opened from the case 2 about the support shafts 14 as the pivot center by removing the screws 15 from the screw holes 3*a* of the brackets 3 of the case 2. Accordingly, even if the housing is mounted at an elevated spot where a place to set aside the cover 7 cannot be assured, the opening/closing operation of the cover 7 is not hindered.

If, however, the housing is mounted at an elevated spot, the operation must sometimes be performed at a narrow place that does not even allow the cover 7 to be opened upward. In this case, the cover 7 must be completely removed from the case 2 without opening the cover 7. When the cover 7 itself is to be replaced, it must be removed from the case 2. In this case, the brackets 3 and 8 are detached and the screws 16 are disengaged and removed from the screw holes 14*a* of the support shafts 14, so that the entire cover 7 is removed from the case 2. At this time, since the support shafts 14 from which the screws 16 are removed are locked by nothing, they might undesirably come out and drop from the through holes 4*a* and 5*a*. To prevent this, the support shafts 14 must be extracted. The operation of extracting the support shafts 14 requires the greatest care since the support shafts 14 are thin and short in the axial direction. Thus, a cumbersome operation is needed that takes a long period of time.

SUMMARY OF THE INVENTION

It is an object of the present invention to provide an opening/closing structure for a housing, which has improved workability.

In order to achieve this object, according to the present invention, there is provided an opening/closing structure for a housing, comprising a box-shaped case having an open portion, a cover for closing the open portion of the case, at least a pair of opposing first hinge members having through holes and formed on one of the case and cover, at least one second hinge member having a through hole and formed on the other one of the case and cover to correspond to the first hinge members, the second hinge member being brought into contact with an outer side of one of the first hinge members to attach the cover to the case, a support shaft having a screw hole in an outer surface thereof and inserted in the through holes of the first and second hinge members to support the cover to be openable/closeable with respect to the case, a groove formed on the second hinge member at a position to correspond to a portion between the first hinge members and open in a direction perpendicular to an axial direction of the support shaft, and a first screw threadably engaged in the screw hole of the support shaft through the groove to clamp and fix the first and second hinge members.

DESCRIPTION OF THE PREFERRED EMBODIMENT

A preferred embodiment of the present invention will be described with reference to the accompanying drawings.

Figure 1:
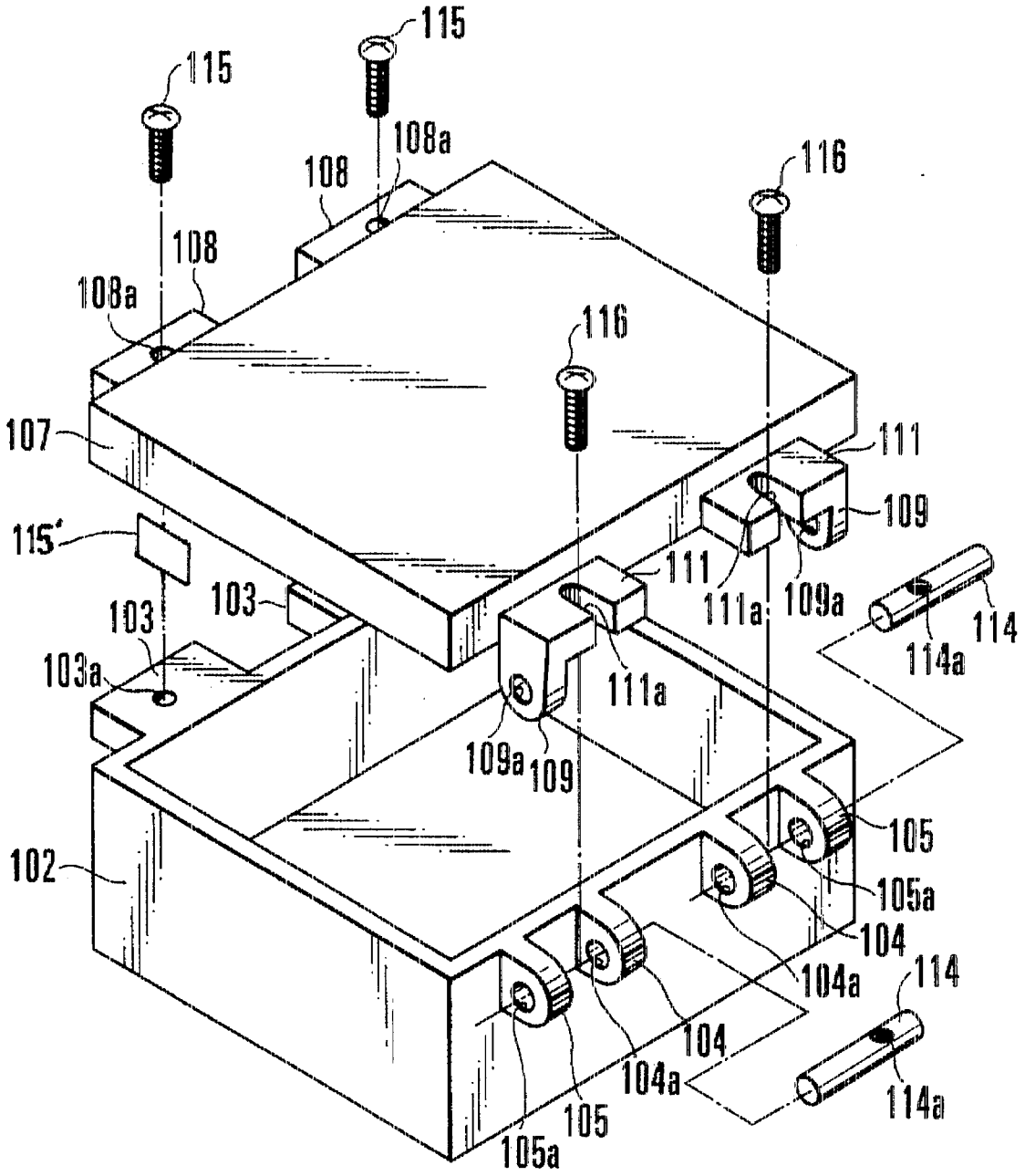
FIG. 1 is an exploded perspective view showing the opening/closing structure for a housing according to an embodiment of the present invention.

FIG. 1 shows an opening/closing structure for a housing according to the present invention. Referring to FIG. 1, reference numeral 102 denotes a box-shaped case having an opening portion which is open upward; and 107, a cover for closing the opening portion of the case 102. A pair of brackets 103 each formed with a screw hole 103*a* are integrally formed on the upper portions of one side surface of the case 102. A total of four hinge members, consisting of two pairs of ear-shaped opposing hinge members 104 and 105 respectively formed with through holes 104*a* and 105*a*, are integrally formed substantially equidistantly on the upper portions of the opposite side surface of the case 102.

A pair of brackets 108 each formed with a screw insertion hole 108*a* are integrally formed on one end face of the cover 107 to correspond to the brackets 103 of the case 102. Two pairs of ear-shaped hinge portions 109 each formed with a through hole 109*a* are integrally formed on the opposing end face of the cover 107 to correspond to the two pairs of hinge members 104 and 105 of the case 102. The side surface of each hinge portion 109 of the cover 107 is in contact with the side surface of the corresponding outer hinge member 105 of the case 102. Each hinge portion 109 of the cover 107 is integrally provided with a bracket 111 having a U-shaped groove 111*a* which is open in a direction perpendicular to a support shaft 114 which is inserted horizontally in the through holes 104*a* and 105*a* of the hinge members 104 and 105 of the case 102 and in the through hole 109*a* of the hinge portion 109 of the cover 107. A screw hole 114*a* is formed at the axial center of the outer surface of each support shaft 114. Reference numerals 115 denote screws threadably engaged in the screw holes 103*a* of the brackets 103 through the screw insertion holes 108*a* of the brackets 108; and 116, screws threadably engaged in the screw holes 114*a* of the support shafts 114 to be locked in the U-shaped grooves 111*a* of the brackets 111.

Figure 2A:
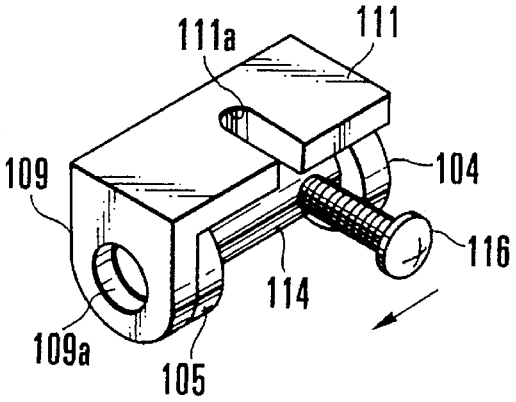
FIGS. 2A and 2B are perspective and sectional views, respectively, showing the main part of the assembling procedure of the opening/closing structure for the housing according to the present invention.
Figure 2B:
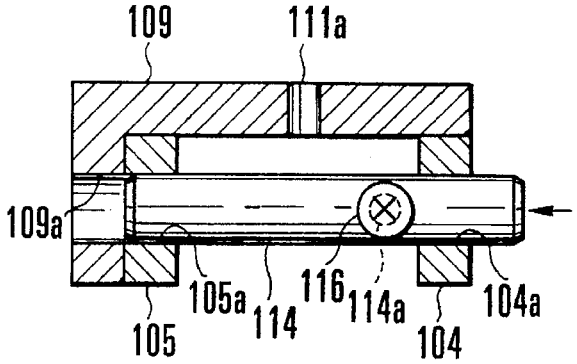

The screw hole 114*a* of each support shaft 114 is formed as follows. More specifically, as shown in FIG. 2B, when the support shaft 114 is inserted through the through hole 104*a* of the hinge member 104 of the case 102 and its distal end is fitted in the through hole 105*a* of the hinge member 105 of the case 102 but is not fitted in the through hole 109*a* of the hinge portion 109 of the cover 107, the screw hole 114*a* of the support shaft 114 is close to the inner side of the hinge member 104. Also, as shown in FIG. 3B, when the support shaft 114 is inserted until its distal end is fitted in the through hole 109*a* of the hinge portion 109, the screw hole 114*a* corresponds to the U-shaped groove 111*a* of the hinge portion 109. The two end portions of the support shaft 114 are chamfered so that they can be easily fitted in the through holes 104*a*, 105*a*, and 109*a*.

The pair of hinge members 104 and 105, the hinge portion 109, the bracket 111, the support shaft 114, and the screw 116 constitute a hinge unit.

The procedure of attaching the cover 107 in the above opening/closing structure for the housing will be described. First, the brackets 108 of the cover 107 are placed on the brackets 103 of the case 102, and the inner side surfaces of the hinge portions 109 of the cover 107 are brought into contact with the outer side surfaces of the hinge members 105 of the case 102 to place the cover 107 on the case 102. Then, as shown in FIGS. 2A and 2B, the support shafts 114 are inserted to fit in the through holes 104*a* and 105*a* of the hinge members 104 and 105 of the case 102. In this state, the screws 116 are threadably engaged halfway in the screw holes 114*a* of the support shafts 114 to be mounted in the support shafts 114.

Figure 3A:
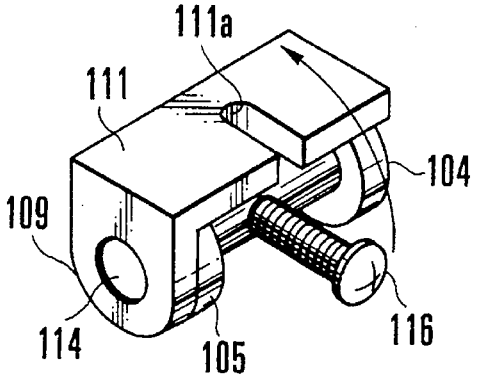
FIGS. 3A and 3B are perspective and sectional views, respectively, showing the main part of the assembling procedure of the opening/closing structure for the housing according to the present invention.
Figure 3B:
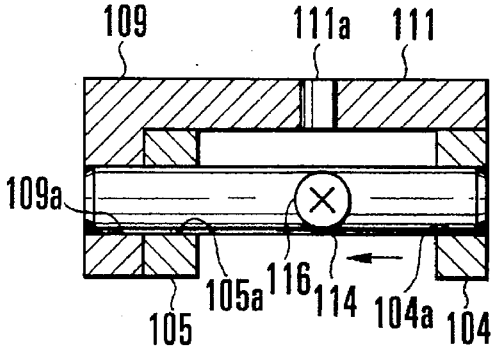

As shown in FIGS. 3A and 3B, the support shafts 114 are further inserted toward the hinge portions 109 until the positions of the screws 116 correspond to the positions of the U-shaped grooves 111*a* of the hinge portions 109, and the distal end portions of the support shafts 114 are fitted in the through holes 109*a* of the hinge portions 109, thereby mounting the support shafts 114. When the support shafts 114 described above are mounted respectively in the two pairs of hinge members 104 and 105, the cover 107 becomes openable/closeable with respect to the case 102 about the support shafts 114 as the pivot center.

Figure 4A:
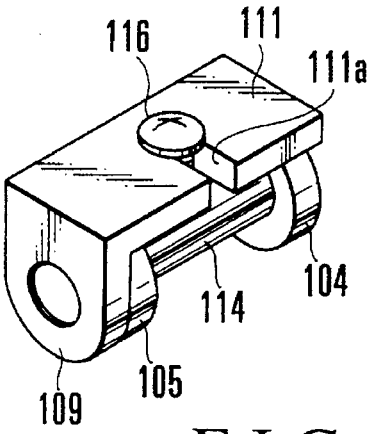
FIGS. 4A and 4B are perspective and sectional views, respectively, showing the main part of the assembling procedure of the opening/closing structure for the housing according to the present invention.
Figure 4B:
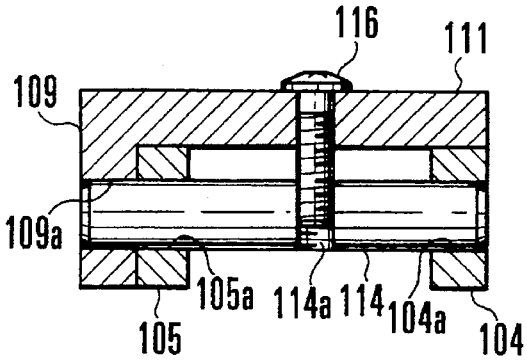
Figure 5:
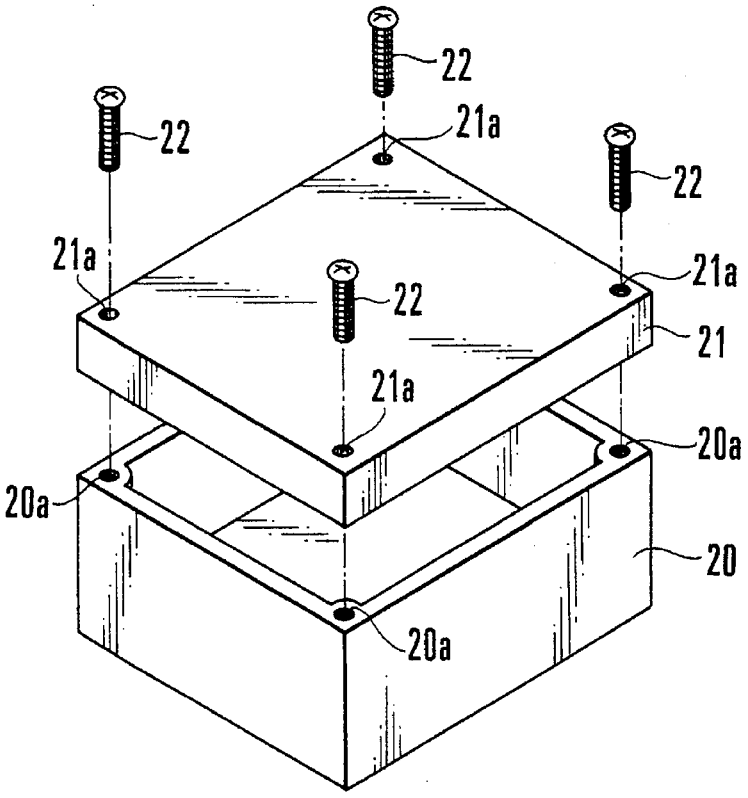
FIG. 5 PRIOR ART
FIG. 5 is an exploded perspective view showing a conventional opening/closing structure for a housing.
Figure 6:
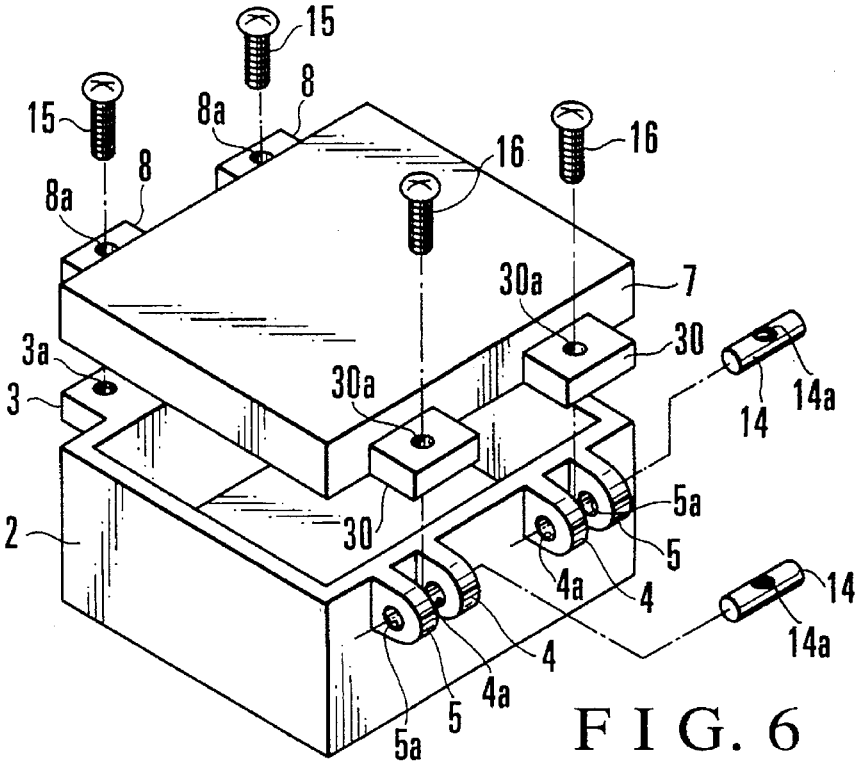
FIG. 6 PRIOR ART
FIG. 6 is an exploded perspective view showing another conventional opening/closing structure for a housing.

As shown in FIGS. 4A and 4B, the support shafts 114 are pivoted through 90° and the screws 116 are locked in the U-shaped grooves 111*a*. The screws 116 are further tightened in the screw holes 114*a* of the support shafts 114 to fix the hinge portions 109 and brackets 111 of the cover 107 on the hinge members 104 and 105 of the case 102 through the support shafts 114. Then, movement of the support shafts 114 in the axial direction is prohibited. Therefore, the rear end portions of the support shafts 114 will not come out from the through holes 104*a* of the hinge members 104.

The screws 115 are inserted in the screw insertion holes 108*a* of the brackets 108 of the cover 107 to threadably engage in the screw holes 103*a* of the brackets 103 of the case 102. Then, the brackets 103 and the brackets 108 are tightened and fixed with each other, so that the cover 107 is attached to the opening portion of the case 102.

When the cover 107 attached to the case 102 in this manner must be opened or closed at an elevated spot, first, the screws 115 are loosened to disengage the brackets 103 and brackets 108 from each other. Then, the screws 116 are slightly loosened to set the hinge portions 109 free from the support shafts 114. As a result, the bracket 108 side of the cover 107 is set openable/closeable about the support shafts 114 as the pivot center.

When the cover 107 need be removed from the case 102, the screws 116 are further loosened from the state as shown in FIGS. 4A and 4B to the state as shown in FIGS. 3A and 3B, and the support shafts 114 are pivoted to disengage the screws 116 from the U-shaped grooves 111*a*. Then, the support shafts 114 are moved in a direction opposite the hinge portions 109. As a result, the distal ends of the support shafts 114 are disengaged from the through holes 109*a* of the hinge portions 109 of the cover 107, as shown in FIG. 2A and 2B, to disconnect the hinge portions 109 from hinge members 105. The hinge portions 109 are then removed from the hinge members 105. At this time, since the screws 116 mounted in the support shafts 114 are locked by the hinge members 104 and axial movement of the support shafts 114 is regulated by the screws 116, the distal ends of the support shafts 114 will not come out from the through holes 105*a* of the hinge members 105, thereby preventing the support shafts 114 from coming out.

In the above embodiment, the two pairs of hinge members 104 and 105 are provided to the case 102, and the two hinge portions 109 are provided to the cover 107. However, the two pairs of hinge members 104 and 105 may be provided to the cover 107, and the two hinge portions 109 may be provided to the case 102.

The hinge portions 109 of the case 102 are provided to contact the outer hinge members 105. However, the hinge portions 109 may be provided to contact the inner hinge members 104. In this case, each hinge portion 109 of the cover 107 should be provided on the opposite side of the bracket 111 with respect to the U-shaped groove 111*a*.

In the above embodiment, as the screws 115 for attaching the cover 107, screws that can be removed from the screw insertion holes 108*a* of the brackets 108 are used. However, screws with the known coming-out preventive function, shown by way of example only at reference numeral 115', may be used, which will not come out from the brackets 108 even if they are removed from the screw holes 103*a* of the brackets 103 of the case 102.

As has been described above, according to the present invention, the screws are threadably engaged in the outer surfaces of support shafts fitted and inserted between hinges, and grooves which are open in a direction perpendicular to the axial direction of the support shafts and in which the screws are to be locked are formed between the hinge members of either the case or cover. Therefore, while the cover is being opened or closed with respect to the case, the support shafts will not come out from the hinge members, thereby improving safety. One of opposing hinge members where the groove is formed is eliminated. The screw threadably engaged in the support shaft is provided at such a position that when one end of the support shaft is disengaged from the through hole of one hinge member, the screw is locked by the other hinge member. Therefore, the cover can be removed from the case by removing one end of the support shaft from the through hole of one hinge member, and the screw of the support shaft is engaged with the other hinge member so that axial movement of the support shaft is regulated. The support shaft will thus not come out from the other hinge member, safety is assured, and the support shaft need not be removed from the through holes, thereby facilitating removal of the cover. Since the opening/closing operation of the cover and the removing operation of the cover can be performed easily in this manner, the workability is improved.

What is claimed is:

1. An openable structure for a housing, comprising:

a box-shaped case having an open portion;

a cover for closing said open portion of said case;

at least a pair of opposed first hinge members having through holes and formed on one of said case and cover;

at least one second hinge member having a through hole, said at least one second hinge member being formed on the other one of said case and cover to correspond to said first hinge members, said at least one second hinge member being brought into contact with an outer side of one of said first hinge members to attach said cover to said case;

a support shaft having a screw hole in an outer surface thereof and inserted in the through holes of said first and second hinge members to support said cover to be openable/closeable with respect to said case;

a groove formed on said second hinge member at a position to correspond to a portion between said first hinge members and open in a direction perpendicular to an axial direction of said support shaft; and a first screw threadably engaged in the screw hole of said support shaft through the groove to clamp and fix said first and second hinge members.

2. A structure according to claim 1, wherein the screw hole of said support shaft is formed at such a position that, when one end of said support shaft is disengaged from the through hole of said at least one second hinge member and two end portions of said support shaft are supported between said first hinge members, said first screw threadably engaged in the screw hole of said support shaft is locked by the other one of said first hinge members to prevent said support shaft from coming out.

3. A structure according to claim 2, wherein the screw hole of said support shaft is formed at such a position that, when said two end portions of said support shaft are supported by said at least one second hinge member and the other one of said first hinge members, said first screw threadably engaged in the screw hole of said support shaft is locked in the groove by pivot movement of said support shaft.

4. A structure according to claim 1, wherein said at least one second hinge member further comprises a bracket integrally formed with said at least one second hinge member.

5. A structure according to claim 1, wherein one of said first and said at least one second hinge members is formed into an ear-like shape on an upper portion of one side surface of said case to be integral with said case, and the other one of said first and said at least one second hinge members is formed into an ear-like shape on an end face of said cover to be integral with said cover.

6. A structure according to claim 1, wherein said first hinge members comprise two pairs of hinge members, and said at least one second hinge member comprises two hinge members to correspond to outer first hinge members of said pairs of first hinge members.

7. A structure according to claim 1, further comprising:

a first bracket having a screw hole and formed integrally with said case on an upper portion of a side surface of said case which is opposite to a side where said first hinge members are provided;

a second bracket having a screw insertion hole and formed integrally with said cover on an end face of said cover which is opposite to a side at least one where said second hinge member is provided, so as to correspond to said first bracket; and a second screw threadably engaged in the screw hole of said first bracket through the screw insertion hole of said second bracket to fix said cover to said case.

8. A structure according to claim 7, wherein said second screw comprises a screw with a coming-out preventive function.

9. An openable structure for a housing, comprising:

a box-shaped case having an opening portion;

a cover for closing said opening portion of said case, at least a pair of opposing first hinge members having through holes and formed on one of said case and cover;

a second hinge member having a through hole and formed on the other one of said case and cover to correspond to said first hinge members, said second hinge member being brought into contact with an outer side of one of said first hinge members to attach said cover to said case;

a support shaft having a screw hole in an outer surface thereof and inserted in the through holes of said first and second hinge members to support said cover to be openable/closeable with respect to said case;

a first bracket formed integrally with said second hinge member at a position of said cover which corresponds to a portion between said first hinge members and having a U-shaped groove which is open in a direction perpendicular to an axial direction of said support shaft; and a first screw threadably engaged in the screw hole of said support shaft through the U-shaped groove of said first bracket to tighten and fix said first and second hinge members, wherein the screw hole of said support shaft is formed at such a position that, when one end of said support shaft is disengaged from the through hole of said second hinge member and two end portions of said support shaft are supported between said first hinge members, said first screw threadably engaged in the screw hole of said support shaft is locked by the other one of said first hinge members to prevent said support shaft from coming out, and that when said two end portions of said support shaft are supported by said second hinge member and the other one of said first hinge members, said first screw threadably engaged in the screw hole of said support shaft is locked in the U-shaped groove of said first bracket by pivot movement of said support shaft.

10. A structure according to claim 9, further comprising:

a second bracket having a screw hole and formed integrally with said case on an upper portion of a side surface of said case which is opposite to a side where said first hinge members are provided;

a third bracket having a screw insertion hole and formed integrally with said cover on an end face of said cover which is opposite to a side where said second hinge members are provided, so as to correspond to said first bracket; and a second screw threadably engaged in the screw hole of said second bracket through the screw insertion hole of said third bracket to fix said cover to said case.

* * * * *